US006524081B2

(12) United States Patent
Wu

(10) Patent No.: US 6,524,081 B2
(45) Date of Patent: Feb. 25, 2003

(54) ONE-STAGE TRANSMISSIBLE TURBOCHARGER

(76) Inventor: Chiang Fu. Wu, 9F 3R, No. 210, Chung Hsueh Rd., Tainan City (TW)

( * ) Notice: Subject to any disclaimer, the term of this patent is extended or adjusted under 35 U.S.C. 154(b) by 0 days.

(21) Appl. No.: 09/873,585

(22) Filed: Jun. 1, 2001

(65) Prior Publication Data

US 2002/0182088 A1 Dec. 5, 2002

(51) Int. Cl.[7] ..... F04B 17/00; F04B 35/00
(52) U.S. Cl. ..... 417/362; 415/124.2; 123/559.1
(58) Field of Search ..... 417/362, 223, 417/212, 213; 415/123, 111, 229, 211.2, 72; 416/176, 177, 183, 185, 244 A; 123/559.1

(56) References Cited

U.S. PATENT DOCUMENTS 2,973,894 A * 3/1961 Kimball et al. ..... 230/127
4,622,818 A * 11/1986 Flaxington et al. ..... 60/624
5,425,345 A * 6/1995 Lawrence et al. ..... 123/559.1
5,443,054 A * 8/1995 Tateno et al. ..... 123/559.1
6,129,510 A * 10/2000 Martin ..... 415/124.2
6,439,208 B1 * 8/2002 Jones ..... 123/559.1

FOREIGN PATENT DOCUMENTS

JP 58030419 A * 2/1983
JP 0 331 355 A1 * 9/1989

* cited by examiner

*Primary Examiner*—Charles G. Freay
*Assistant Examiner*—Han L. Liu

(57) ABSTRACT

A one-stage transmissible turbocharger includes a turbine wheel contained in a front current-guider and a rear current-guider, increasing air pressure to elevate horsepower and speeding up burning of gas coming out of a carburetor to save fuel consumption. The turbine wheel has a plurality of leaves respectively helically formed to have 32 angles to make a catch inlet section to elevate air volume to be caught in, and a final axial pressure section for producing centrifugal current so as to give the turbine wheel functions of both axial current and centrifugal current. In addition, the turbocharger has buffer springs for protecting a belt wheel and its bolts from damaged or broken.

1 Claim, 6 Drawing Sheets

ONE-STAGE TRANSMISSIBLE TURBOCHARGER

BACKGROUND OF THE INVENTION

This Invention relates to a one-stage transmissible turbocharger, particularly to one transmissible from an engine, possible to increase pressure the turbocharger should have only by one stage, attaining the objective of fuel-saving by elevating horsepower of an automobile and speeding up burning of gas coming from a carburetor.

Many different turbochargers such as G style, Root style, Screw style, have been used in cars. But the most ideal condition of a turbocharger used in a car is that the engine speed (rpm) and the air pressure (bar) have effect of pressure increase from the start of the engine, and in other words, air pressure has a 45 straight line in comparison with the engine speed. But conventional turbochargers do not begin to have increased air pressure until a car speeds up to 3000 or 4000 rpm, and its pressure swiftly increases to produce instantly and substantially large thrust to the car. Then the engine speed and the air pressure may have curved graphic relation to cause danger, should a driver not know well the function of the car.

A U.S. Pat. No. 4,155,684 discloses a kind of turbocharger including a four-stage pressure increasing system, having a lower pressure stage containing a compressor wheel and a turbine wheel, and a high-pressure stage containing a compressor wheel and a turbine wheel.

But the turbocharger with four-stages of pressure increase has a flaw of a large size, and its material have to be specially treated to endure high temperature and abrasion so as to receive waste high temperature of an engine.

Then another conventional turbocharger disclosed in Taiwan patent No. 66706 (a first generation one by the applicant) includes a one-stage turbocharger and a two-stage turbocharger, a one-stage current-guider and a two-stage current-guider, a one-stage axial current-guider and a two-stage axial current-guider. Thus this mechanical turbocharger has a very complicated structure, a very long current guiding route, so it takes a very long time for pulled in wind pressure by the one stage turbocharger from an wind exit to the carburetor, so partial backwash to affect quality of air pressure. So the applicant thought out a turbocharger of a second generation wherein an axial pressure section of the one-stage and the two-stage turbo wheel having leaves moderated. However, the second generation of the turbocharger has the same flaw as the first generation, so the applicant disclosed a third generation of turbocharger in Taiwan patent of No. 102747, which diminishes its structure and also makes its flowing course shorter, the dimensions smaller and improved air pressure movement so as to attain effectual pressure increase.

The turbocharger (the first generation) of Taiwan patent of No. 66706, and that (the third generation) of No. 102747 and U.S. patent of application of Ser. No. 08/074191 (the second generation) all make use of two-stage turbine wheel to attain ideal pressure increase.

The turbocharger of the second generation uses a one-stage turbine wheel for pulling in fresh air, and a two-stage turbine wheel for reinforcing air pressure to obtain the purpose of pressure increase. A common problem is air backwash possible to happen in a housing because of a long air flowing route of the two-stage turbine wheel. Air backwash is a pressing problem worth serious consideration, and if there is any error, the air flowing route may have air turbulence owing to air backwash. Therefore, pressure increase may be offset in case of air turbulence. So in order to prevent pressure backwash and air turbulence-possibly caused by air backwash, a current-guider (or an axial current leaves) has to be added between the one-stage turbine wheel and the two-stage turbine wheel. Then the turbocharger may become larger in dimensions, not easy to fix it in the engine room already formed, only applicable to those cars having a comparatively large air exhaust, in addition to the one-stage and the two-stage turbine wheel needing comparatively large transmitting force to result in using comparatively large transmitting horsepower of the engine. These disadvantages are commonly found in the first, the second and the third generation of a turbocharger described above.

Further, The conventional turbine wheels have leaves of a centrifugal type, a 45 angle inclined type, and an axial current type for catching air and preventing pressure reversing, but those three types have a simple structure, impossible to get pressure increasing effect it should have, except increasing stages, or those three types of leaves are not proper for a single turbocharger.

SUMMARY OF THE INVENTION

The objective of the invention is to offer a one-stage transmissible turbocharger having high safety and direct proportion of air pressure increase and the engine speed so as to elevate horsepower of an automobile and to save fuel consumption.

The features of the invention are listed as follows.

1. It uses a one-stage turbocharger having small dimensions, not liable to produce air turbulence, keeping low degree of air pressure increasing and high current volume, and having real function of air pressure increase.

2. It has a one-stage turbine wheel having leaves provided with four layers of preventing backwash of air pressure, and each small leaf of the turbine wheel has a catch inlet section of 32 degrees to elevate fresh air volume caught in, and a final section formed in a current following type to let air centrifuge smoothly without backwash or reverse current.

3. The turbine wheel has leaves formed in a centrifugal turbine style for catching in and pushing air pressure for obtaining low-pressure air current and high flowing volume.

4. The turbine wheel has the leaves designed to have four layers and five-stages for preventing air pressure backwash, pulling in air volume from the catch inlet section and then pushed to flow in the axial flowing direction, reducing air pressure backwash to the minimum. Any group of the four layers consisting of four small leaves prevents air pressure backwash, with neighboring small leaves doubly organizing anti-backwash and pushing pressure. The five stages means each small leaf including five stages of the catch inlet section to the axial flowing and pushing pressure section so that air caught in is added with pressure and prevented from reversing air pressure and current.

5. The catch inlet section of each small leaf is inclined for 32 degrees to catch the largest air volume, and the axial flowing and pushing pressure section is formed to follow current direction to let air centrifuge smoothly.

6. A large gear contains a buffer spring within its shaft in order to protect a belt wheel combined with a transmitting shaft and two one-way bearings in the large gear.

7. A sleeve of the belt wheel is provided with a plurality of buffer springs for preventing the bolts from breaking by alteration of rotating speed, and excessive large torque.

BRIEF DESCRIPTION OF DRAWINGS

This invention will be well understood by referring to the accompanying drawings, wherein:

FIG. 1 is a cross-sectional view of a one-stage transmissible turbocharger in the;

DETAILED DESCRIPTION OF THE PREFERRED EMBODIMENT

Figure 1:
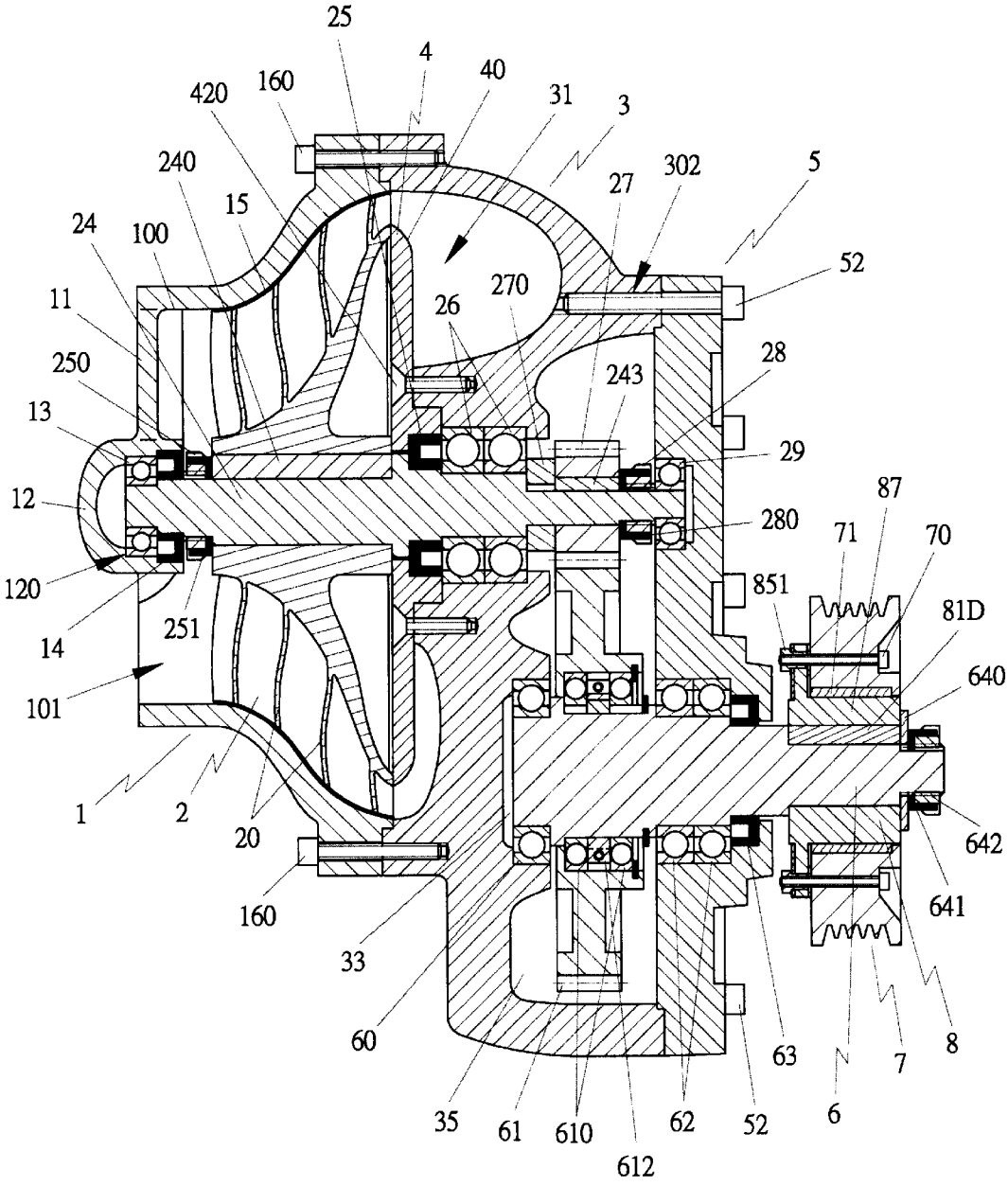
Figure 2:
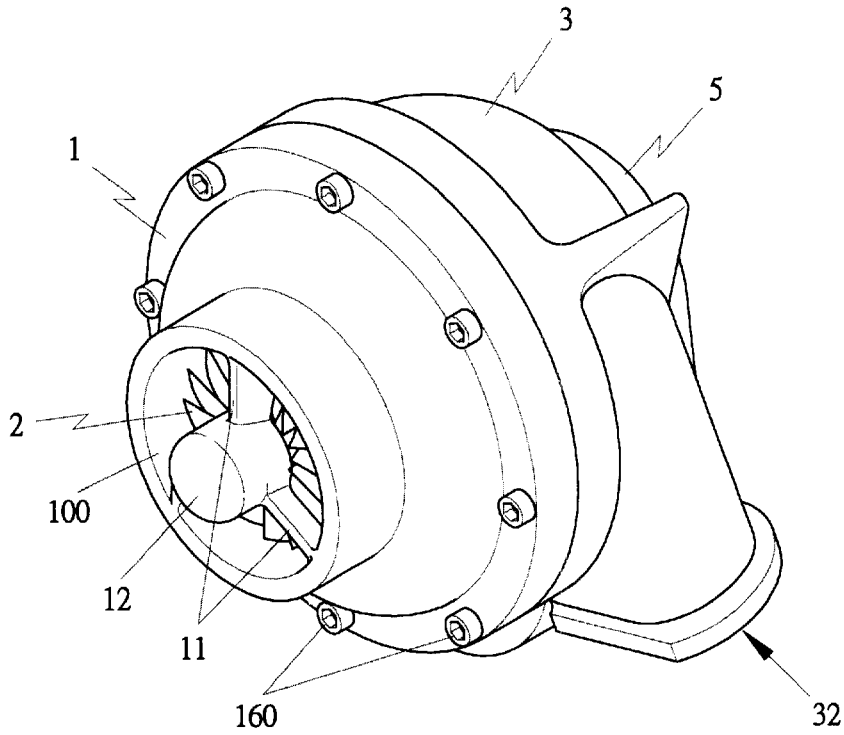
FIG. 2 is a perspective view of the one-stage transmissible turbocharger in the present invention.
Figure 3:
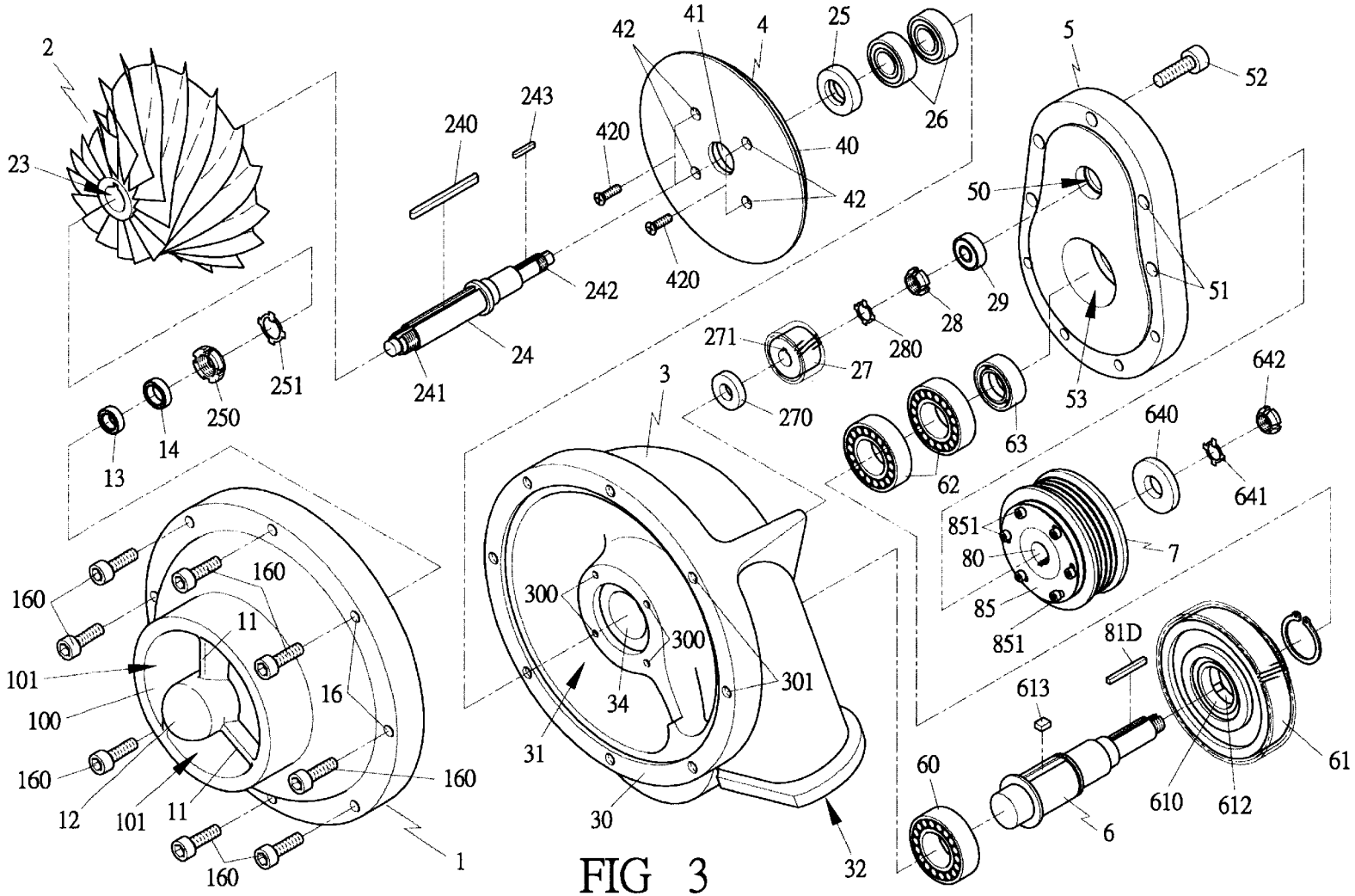
FIG. 3 is an exploded perspective view of the one-stage transmissible turbocharger in the present invention.
Figure 5:
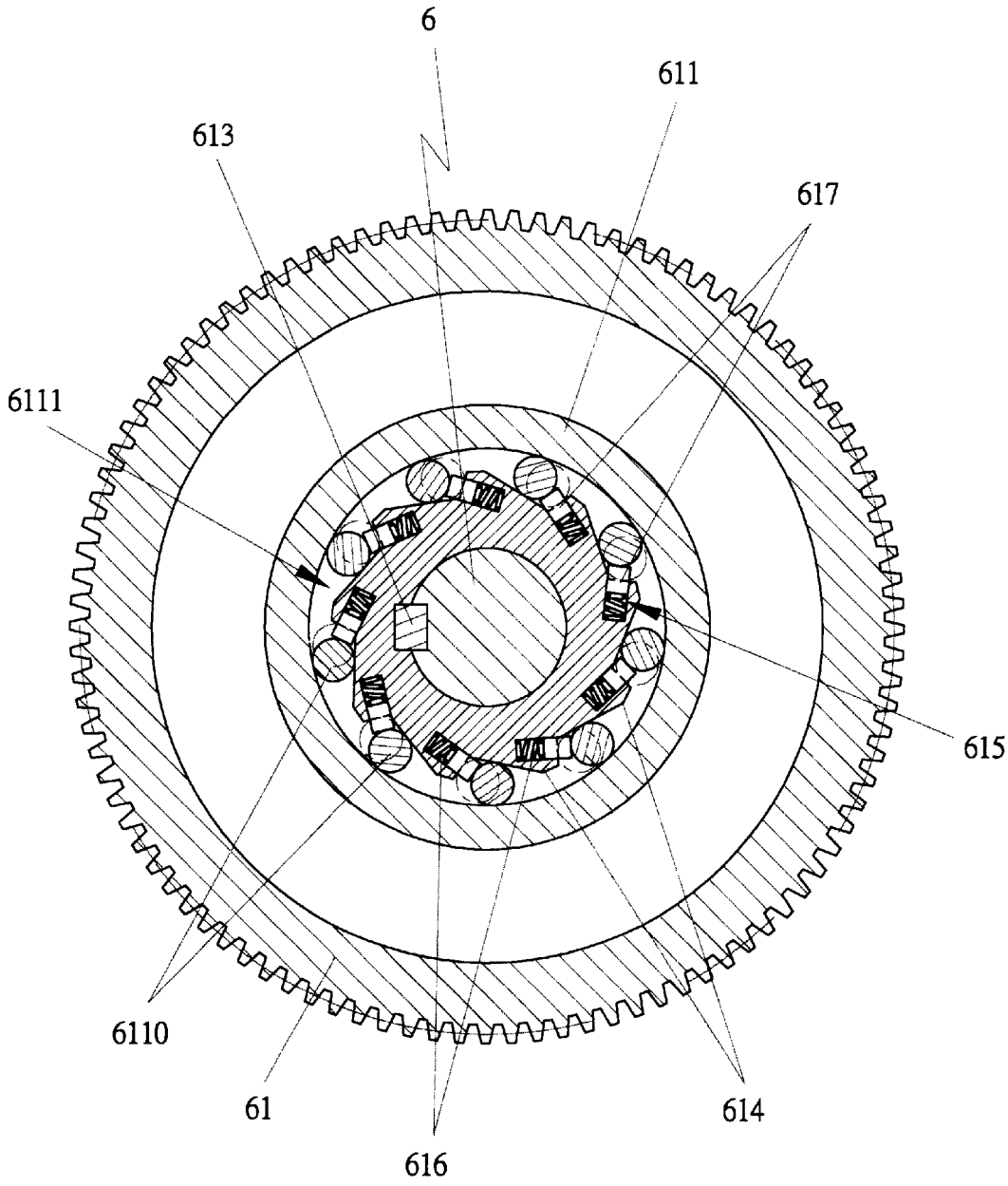
FIG. 5 is a cross-sectional view of a large gear in the present invention.
Figure 6:
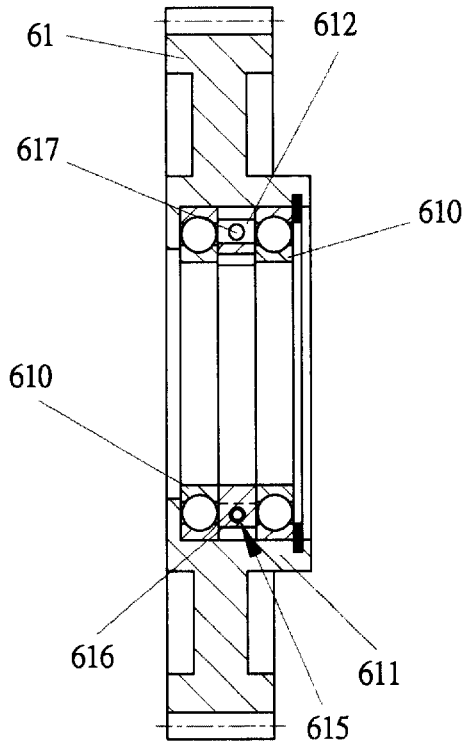
FIG. 6 is a side cross-sectional view of the large gear in the present invention.

A one-stage transmissible turbocharger in the present invention, as shown in FIGS. 1 and 3, includes a front current-guider 1, a turbine wheel 2, a rear current-guider 3, a current-guiding disc 4, a rear cover 5, a transmitting shaft 6, a belt wheel 7 and a sleeve 8 as main components combined together.

The front current-guider 1 has an intake opening 101 formed in the front center portion, an annular inner wall 100 defining the intake opening 101, a center shaft base 12 formed in the center of the opening 101 and three ribs radially provided between the annular inner wall 100 and the center shaft base 12, a bearing groove 120 formed in an inner wall of the center shaft base 12 for a ball bearing 13 and a shaft seal 14 to fit in. Further, the front current-guider 1 has an inner annular wall 15 shaped according to the shape of the turbine wheel 2 so as to keep the best distance to the turbine wheel 2 so that air pressure caught in by the turbine wheel 2 may not easily flow reversely. The inner annular wall 15 connects to a front wall 30 of the rear current-guider 3, forming an air passageway 31. The front current-guider 1 also has a plurality of threaded holes 16 provided axially in a large rear annular circumferential wall for bolts 160 to screw to combine with the rear current-guider 3.

Figure 4:
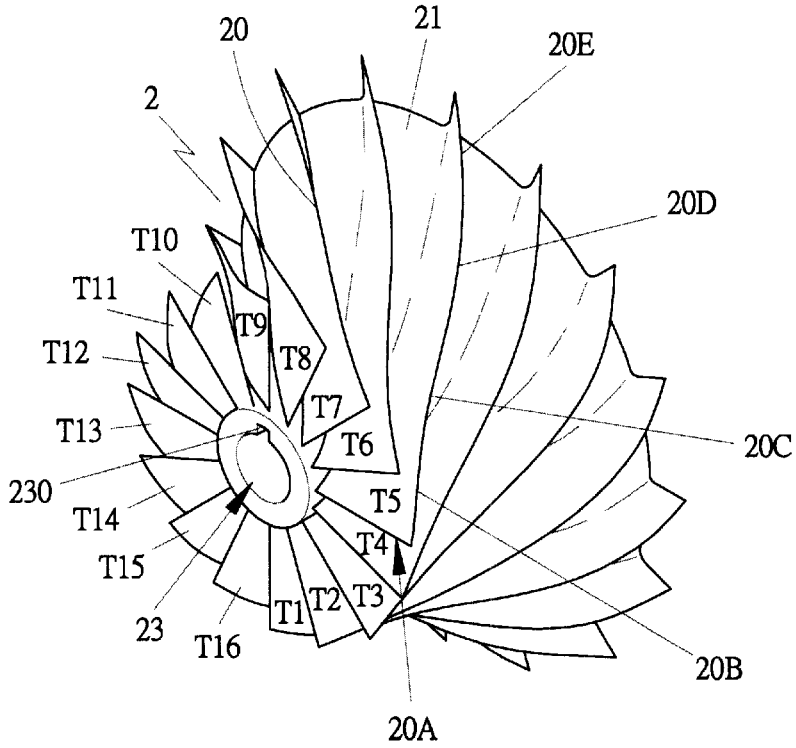
FIG. 4 is a perspective view of a turbo wheel in the present invention.

The turbine wheel 2 is formed integral, having at least a plurality (T1–T15) of leaves 20 helically arranged on a surface 21 thereof, as shown in FIGS. 3 and 4. Each leaf 20 has five continual sections, namely a catch inlet section 20A, an angle pressure increasing section 20B, an anti-backwash section 20C, a centrifugal pressure section 20D and an axial pressure section 20E. And any group of four neighboring leaves 20 form an anti-backwash layer, and forming a straight line from the axial pressure section 20E of the first leaf T1 to the catch inlet section 20*a* of the fourth leaf T5. That means that air current pulled in through the catch inlet section 20A of the first leaf T1 passes through the four-stage anti-backwash layer to reduce air backwash possibility to the minimum and pulling-in capacity to the maximum. This invention is the fourth generation of a turbocharger, utilizing the four-layer anti-backwash function, having good advantage of pressure increasing and anti-backwash, superior to the first, the second and the third generation of a turbocharger described above. In addition, the leaves 20 make use of five stages of catching in air, pressure increasing, preventing backwash, returning pressure centrifugally, and pushing axial pressure. In this invention, the catching-in angle of the catch inlet section 20A is changed to 32 degrees from conventional 45 degree to acquire the best result, and when passing through the four sections to the final section, the turbine wheel leaves are formed to have direction following shapes to let the centrifugal axial pressure section not liable to produce backwash. In addition, the dimensions of the product can be reduced, resulting in increasing effectiveness, possible to be applied to various automobiles having a large or a small exhausting air capacity, say 1600 CC–4000 CC. Further, the turbine wheel 2 is located inside the inner annular wall 15 of the front current-guider 1, having a shaft hole 23 with a key groove 230 for a shaft 24 to fit through and fixed in place with a long key 230, and rotated by the shaft 24. The shaft 24 has male threads 241 and 242 formed respectively in a front section and a rear section and the front male threads 241 engages with nuts 250 and washers 251 to fix firmly the turbine wheel 2 to keep the same turbine wheel 2 in place.

The current-guiding disc 4 is fixed behind the turbine wheel 2, having a curved current guiding surface 40 as shown in FIG. 1, a center shaft hole 41 for the shaft 24 to pass through, a plurality of threaded holes 42 spaced apart around the center shaft hole 41 for bolts 420 to screw with threaded holes 300 around a shaft hole 34 of the rear current-guider 3 to fix the current guiding disc 4 with the rear current-guider 3. The shaft 24 has its end received in the shaft seal 25 and supported in the ball bearing 26 after passing through the shaft hole 41 of the current guiding disc 4. The two ball bearings 26 are deposited in the shaft hole of the rear current-guider 3, letting the shaft passing through the shaft hole 34, then through a shaft sleeve 270, and then fixed with a pinion 27 with a key groove 271 for a key 243 to combine the pinion 27 with the shaft 24 firmly. Then when the pinion 27 is rotated, it rotates the shaft 24 and the turbine wheel 2. The male threads 242 of the shaft 24 engages with a nut 258 with a washer 280, and a ball bearing 29 fits around the end of the shaft 24, received in a small shaft hole 50 of the rear cover 5.

The rear current-guider 3 has a plurality of threaded holes 301 on an annular front end surface for bolts 160 to engage with, and a plurality of threaded holes 302 in an annular rear end surface respectively facing threaded holes 51 of the rear cover 5 for bolts 52 to screw with to combine the rear current-guider 3 with the rear cover 5. The rear current-guider 3 has an air passageway 31 and an air exit 32 for guiding increased air pressure to the intake of the carburetor, and a bearing groove 33 for a ball bearing 60 to fit therein and for the transmitting shaft 6 to pass through and also through a large gear 61, which then engages with the pinion 27. Further, the large gear 61 and the pinion 27 are also located in an lubricating oil chamber 35 formed in the rear current-guider 3, and two one-way bearings 610 are deposited in a center hole of the large gear 61, with a shaft sleeve 611 and an inner shaft sleeve 612 inside the shaft sleeve 611 sandwiched between the two one-way bearings 610. The inner shaft sleeve 612 is firmly fixed with the transmitting shaft 6 with a key 613, having a plurality of ratchet teeth 614, and each ratchet tooth 614 has a spring groove in one side for a buffer spring 616 to fit therein, and a top block 617 is provided at one side of each buffer springs 616. Then each top block 617 contacts a round post 6110 positioned in a hole 6111 of the shaft sleeve 611. Therefore, when the engine speed alters and the transmitting shaft 6 cannot at once correspond to the speed alteration, the one-way bearings and the transmitting shaft may reduce damage. Further, the left end of the transmitting shaft fits in two ball bearings 62 and a shaft seal 63, and the two ball bearings 62 and the shaft seal 63 are received in a large shaft hole 53 of the rear cover 5.

Figure 8:
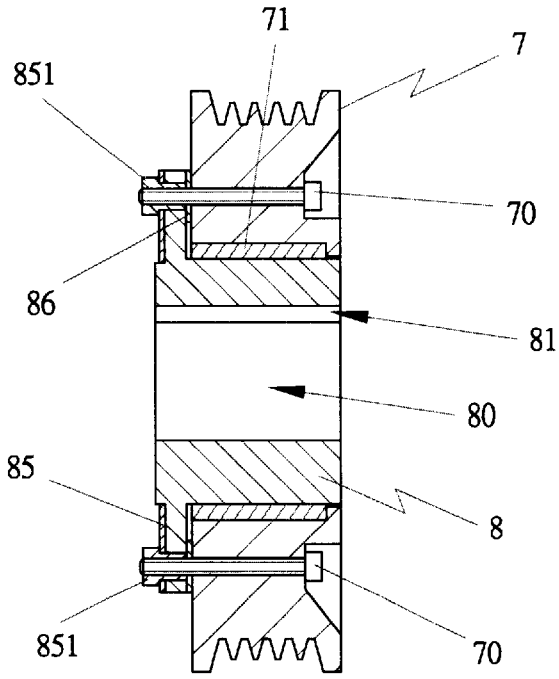
Figure 7:
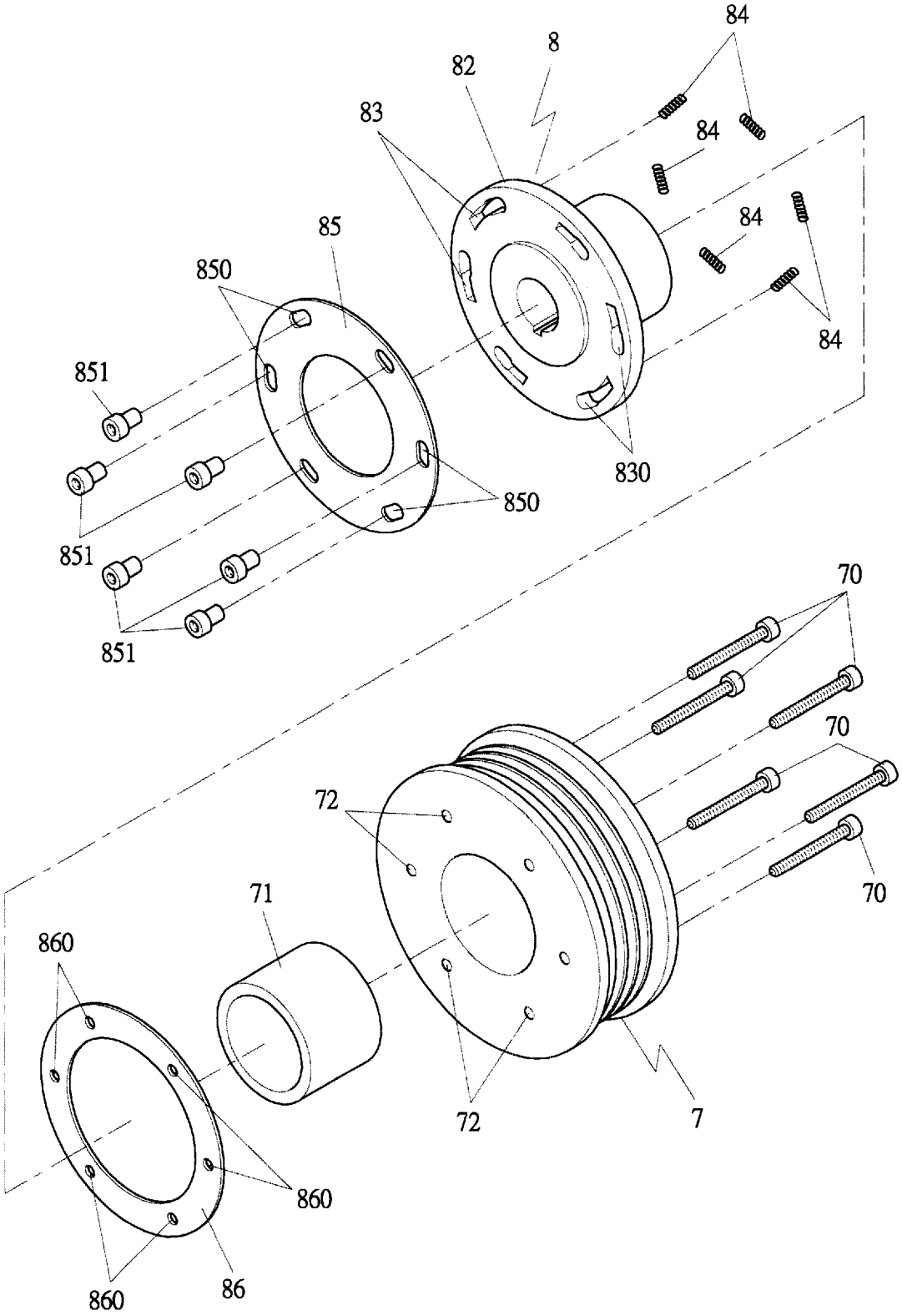
FIG. 7 is an exploded perspective view of a belt wheel in the present invention; and, FIG. 8 is a side cross-sectional view of the belt wheel in the present invention.

The belt wheel 7 has a bush 8 fitted in a center hole and then the bush 8 together with the belt wheel 7 are fixed on a left portion of the transmitting shaft 6 protruding out of the rear cover 5. The bush 8 has a center shaft hole 80 with a key groove 81 for a key 81D to fit in to fix firmly the belt wheel 7 indirectly with the transmitting shaft 6 to permit the belt wheel 7 rotate the transmitting shaft 6. The belt wheel 7 is directly rotated by the engine synchronously with the same speed as the engine, so rotating speed of the engine directly affect rotating speed of the turbine wheel 2. So the transmitting shaft 6 may not be possible to respond to the alteration of the engine speed to result in break of the bolts 70. In order to solve this disadvantage, the bush 8 of the belt wheel 7 has a large diameter portion 82 and a small diameter portion 87, and the large diameter portion 82 is provided with a plurality of curved spring holes 83 arranged to space apart near an outer circumferential edge for fitting a plurality of buffer springs 84 respectively in the spring holes 83. Further, an annular left cover 85 closes an outer end surface of the large diameter portion 82, having a plurality of slots 850 spaced apart to face corresponding to the spring holes 83, and a plurality of T-shaped nuts 851 respectively put to pass through the slots 850 into a large section of each spring hole 83 and also into a plurality of round holes 860 of a right annular cover 86 closing the right side of the large diameter portion 82 and also containing the left side of the belt wheel 7. The belt wheel further 7 has its center hole fitted with an inner sleeve 71 fitting around the small diameter portion 87 of the bush 8, and a plurality of bolt holes 72 for bolts 70 to pass through to engage with the T-shaped nuts 851 as shown in FIGS. 7 and 8. Then the resilience of the buffer springs 84 can moderate or buffer alteration of the engine speed, which is then directly transmitted to the transmitting shaft 6. In this way, the bolts 70 are not liable to break owing to provision of the buffer springs 84.

While the preferred embodiment of the invention has been described above, it will be recognized and understood that various modifications may be made therein and the appended claims are intended to cover all such modifications that may fall within the spirit and scope of the invention.

What is claimed is:

1. A one-stage transmissible turbocharger comprising:

a front current-guider having a front intake hole defined by an annular wall, three ribs formed between said annular wall of said intake hole and a bearing base of a turbine wheel, said bearing base having an inner bearing groove for receiving a ball bearing and a shaft seal therein, an inner annular wall of said front current-guider forming an air passageway by combining with a front wall surface of a rear current-guider, said turbine wheel having at least a plurality of leaves helically formed on a surface; each leaf of said turbine wheel having five continual sections, any group of four neighboring leaves forming an anti-backwash layer, an angle for catching in air changed to 32 degrees from the conventional 45 degrees for catch inlet section, of said leaf;

said turbine wheel located in said inner wall of said front current-guider, having a center shaft hole with a key groove for a shaft to fit therein and fixed firmly with a long key fitting in said key groove, said shaft rotating said turbine wheel, said shaft further having male threads respectively formed in a front and a rear section, said turbine wheel fixed with said shaft by means of said front male threads engaging with a nut and a washer;

a current guiding disc provided behind said turbine wheel, having a curved guiding surface on a right side, a center shaft hole for said shaft to pass through, a plurality of threaded holes formed around said center shaft hole for bolts to screw said current guiding disc with a rear current-guider, said shaft received in two ball bearings and a shaft seal after passing through said current guiding disc, said two ball bearings deposited in a shaft hole of said rear current-guider with said shaft passing through said shaft hole and through a shaft ring to be fixed with a pinion thereon by means of a key fitted in a key groove of said pinion to combine said pinion with said shaft, said shaft and said turbine wheel rotated by said pinion, said rear male threads of said shaft fitted around with a washer, then screwing with a nut and fitted around with a ball bearing deposited in a small shaft hole of a rear cover;

said rear current-guider having a plurality of front threaded holes for bolts to combine said rear current-guider with said front current-guider, said rear current-guider having a plurality of rear threaded holes for bolts to combine said rear current-guider with said rear cover, said rear current-guider having an air passageway as an air outlet for augmented air pressure to be guided to an intake of a carburetor of an engine, said rear-current-guider having a bearing groove for a ball bearing to fit therein;

a transmitting shaft passing through said ball bearing for a large gear fixed thereon, said large gear engaging with said pinion, said large gear and said pinion contained in an lubricating oil chamber formed in said rear current-guider, said large gear having two one-way bearings fitted in a center hole, a shaft sleeve fitted between said two ball bearings, said shaft sleeve having an inner shaft sleeve fixed firmly with said transmitting shaft with a key, said inner shaft sleeve having a plurality of ratchet teeth spaced apart on an outer surface, each said ratchet tooth having a spring groove in an inner side for receiving a buffer spring therein, each said buffer spring having a top block to contact resiliently with a round post deposited in a hole of said shaft sleeve, said transmitting shaft having its right side fitted with two ball bearings and a shaft seal, said two bearings and said shaft seal deposited in a large shaft hole of said rear cover;

a belt wheel having a bush fixed in its center hole, said bush having a shaft hole and key grooves formed in an inner and outer side of said shaft hole for keys to fit therein so as to indirectly combine said belt wheel firmly with said transmitting shaft to rotate together, said sleeve of said belt wheel having a large diameter portion and a small diameter portion, said large diameter portion having a plurality of curved spring holes spaced part near its outer edge for a plurality of buffer springs to fit therein, an annular left cover closing a left side of said large diameter portion and having a plurality of slots spaced apart and corresponding to said spring holes of said large diameter portion, a plurality of T-shaped nuts fitting in said slots of said left cover and into a large section of each said spring hole of said large diameter portion, an annular right cover closing a right side of said large diameter portion and having a plurality of round holes and contacting a left side of said belt wheel;

said belt wheel having an inner sleeve fitted in its center hole, said inner sleeve fitting around said small diameter portion of said bush, said belt wheel further having a plurality of threaded holes spaced apart in a left side surface and extending to a right side surface for a plurality of bolts to fit through to engage with said T-shaped nuts to combine said bush and said belt wheel with said transmitting shaft.

* * * * *